United States Patent [19]

Luna

[11] Patent Number: 4,582,319

[45] Date of Patent: Apr. 15, 1986

[54] SIT-UP EXERCISE BENCH

[76] Inventor: Mario A. Luna, 2437 S. Kevin Dr., Tucson, Ariz. 85748

[21] Appl. No.: 607,436

[22] Filed: May 7, 1984

[51] Int. Cl.[4] ..... A63B 21/04

[52] U.S. Cl. ..... 272/136; 272/123; 272/134; 272/142

[58] Field of Search ..... 272/134, 135, 142, 144, 272/123, 136, 138, 137, 139, 140, 141

[56] References Cited

U.S. PATENT DOCUMENTS

| | | | |
|---|---|---|---|
| 3,558,131 | 1/1971 | Dragon | 272/142 X |
| 3,664,666 | 5/1982 | Lloyd . | |
| 3,709,487 | 1/1973 | Walker | 272/134 |
| 3,834,694 | 9/1974 | Pridgen . | |
| 4,136,609 | 2/1982 | Silberman . | |
| 4,198,044 | 4/1980 | Holappa | 272/135 |
| 4,252,314 | 2/1981 | Ceppo . | |
| 4,319,747 | 3/1982 | Rodgers | 272/134 X |
| 4,344,618 | 8/1982 | Dudley . | |
| 4,372,553 | 2/1983 | Hatfield | 272/142 X |
| 4,403,773 | 9/1983 | Swann | 272/134 |
| 4,405,128 | 9/1983 | McLaughlin et al. | 272/134 X |

*Primary Examiner*—Richard J. Apley
*Assistant Examiner*—Robert W. Bahr
*Attorney, Agent, or Firm*—J. Michael McClanahan

[57] ABSTRACT

A sit-up exercise bench comprising a horizontal platform connected to a slant-adjustable back rest, a harness adapted to be engaged by an exerciser's shoulder, said harness operably connected to a restraining spring attached to said horizontal frame whereby an exerciser, reclining upon the bench, may perform sit-up exercises from the waist, sitting up against the resistance provided by the tension springs. In an alternate embodiment, a pivotable arcuate-shaped bar attached to tension springs for engagement by the exerciser's legs provide restraining force to movement of the exerciser's legs in two positions.

7 Claims, 4 Drawing Figures

SIT-UP EXERCISE BENCH

BACKGROUND OF THE INVENTION

Exercising of the different body limbs and other parts of the body have, in recent years, enjoyed a surge in popularity which has resulted in a plethora of exercise machines to accomplish exercises for different areas of the body. For example, many exercise machines are known which exercise primarily the arms such as the exercise machines shown in U.S. Pat. No. 4,316,609 to Silberman, and for leg exercises as shown in the patent of Pridgen, U.S. Pat. No. 3,834,496. Various other patents, such as U.S. Pat. to Lloyd, No. 3,664,666; Dudley, No. 4,344,618; and Ceppo, No. 4,252,314, show various exercise devices for combination exercises where both exercising of the arms and the legs may be accomplished. However, no devices presently exist for accomplishing sit-up exercises where the exerciser is working against a restraint other than body weight or body position in doing the exercise. The patents above to Lloyd and Silberman, however show sit-up benches for accomplishing sit-up exercises without the use of a restraint or other means whereby weight is added to the shoulders to effect an increased effort to do the exercise. In exercising through sit-up exercises, it is possible to strengthen the lower back muscles through continued practice.

It is to the desire of the Inventor to provide a device whereby sit-up exercises may be accomplished and to which variable restraints may be applied to enable the exerciser to build up the body muscles which are utilized when doing the exercises.

SUMMARY OF THE INVENTION

The subject invention is a device whereby an exerciser may accomplish sit-up exercises while at the same time applying restraint to the exerciser's shoulders to increase the effort which the exerciser must expend in performing the exercise over that without the restraint. By such means, the muscles which are utilized by the body in accomplishing the exercises may be strengthened.

To this end, the preferred embodiment of the invention employs a horizontal bench for the exerciser to recline on, with the front end of the bench on which the exerciser would place his back hinged in order that it may be set at a desirable angle. Located at the front portion of the bench proximate the slanted raised front end are a pair of shoulder harnesses, the harnesses in turn attached by a rope which encircles a pulley near the front end of the bench, the rope next directed to one or more tension springs, the other end of the tension springs anchored to the bench frame. By such placement of the pulley from which the rope emerges, the restraining force applied to the exerciser's shoulders is applied at an angle approximated perpendicular to the plane of the exerciser's back. Suitable adjustment of the location of tension springs and/or length of the rope allows the exerciser to engage the restraining force at any time in the sit-up exercise, either initially from the reclining position or any point in the pivotal movement of the exerciser's back as it rotates at the waist. The opposing spring tension restraint may be varied by choice of interchangable springs, or by the addition of a plurality of tension springs. The sit-up bench is characterized by a horizontal foot hold down bar spaced above the rear end of the sit-up bench surface to provide means to keep the exerciser's legs from rising as he performs the sit-up exercises.

In an alternate embodiment fo the invention, additional features for leg exercises are added at the rear portion of the bench where, utilizing the same spring tension mechanism as was used in the sit-up exercises, a pivoting bar with cross members at each end adapted to engage the sitting exerciser's legs in a down-vertical configuration in one position, or, the exerciser's legs in a straight-out configuration in a second position while the exerciser is on his stomach. With the exerciser's legs in a down configuration, the cross member attached to the pivotal bar is raised against the spring tension restraint by the exerciser rotating his legs outward and upward. In the second position, the pivotal bar may be pivoted frontwards against spring tension by the exerciser, laying on his stomach on the bench, by bringing his legs from a substantially horizontal position to a back-folded position.

It is an object of the subject invention to provide a device by which an exerciser may accomplish sit-up exercises while working against a restraining weight or force.

It is further an object of the subject invention to provide a combined exercise bench for performing sit-up exercises against a restraining force, and to provide leg exercises for the legs also to work against a restraining force.

Other objects of the invention will in part be obvious and will in part appear hereinafter. The invention accordingly comprises the apparatus possessing the construction, combination of elements, and arrangement of parts which are exemplified in the following detailed disclosure, and the scope of the Application which will be indicated in the Claims.

BRIEF DESCRIPTION OF THE DRAWINGS

For further understanding of the nature and objects of the present invention, reference should be had to the following detailed description taken in connection with the accompanying drawings wherein.

In the various views, like index numbers refer to like elements.

DETAILED DESCRIPTION OF THE PREFERRED EMBODIMENT

Figure 1:
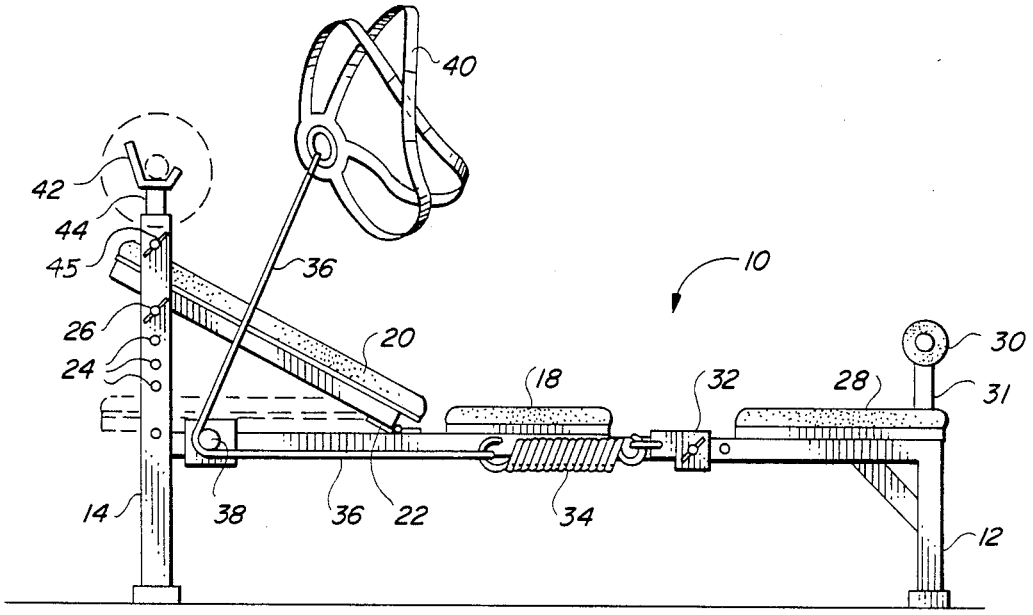
FIG. 1 is a side elevational view of the inventive sit-up exercise bench.

Referring now to FIG. 1, a side elevational view of the inventive sit-up exercise bench 10 is shown.

Proceeding from the ground level, the exercise bench has two rear legs 12 and two front legs 14. Both pair of legs are braced to the center support frame 16 by angle braces. All legs have a rubber foot attached at their end for placement on the floor.

Center support frame 16, nominally 6 feet long or so, is designed to support the weight of an exerciser sitting on seat cushion 18 generally mid-way between the legs. Immediately to the front of seat cushion 18 is hinged back cushion 20 which provides an adjustable angle backrest for the exerciser. The hinged back cushion 20 hinge 22 is attached to center support frame 16 at at least two positions. The angle of hinged back cushion 20 may be adjusted by placement of back adjustable rod 22 which spans the distance between the two front legs 14 and resides in one of the plurality of openings 24 which appear in each of the two front legs 14. Shown in FIG. 1 is the wing nut 26 which screws on to each of the threaded ends of the back adjustable rod 22, the circular end of such rod being the only part visible in FIG. 1.

At the rear portion of center support frame 16 is rear leg cushion 28 which lies atop the center support frame 16. Immediately above the rear portion of rear leg cushion is the tubular foot hold down bar 30. Foot hold down bar 30 is preferably covered with vinyl plastic over interior padding, as are the cushions 28, 18 and 20.

Running parallel to the longitudinal side of center support frame 16 is adjustable spring holding mechanism 32 comprising a short piece of $\frac{3}{4}$ square iron plate with a hook attached on one side. Through two sides of the iron plate is a hole through which a bolt is pushed to engage a corresponding hole in center support frame 16 and then through a hole on the opposite side of the iron plate. Shown in FIG. 1 is adjustable spring holding mechanism 32 in place with a wing nut screwed on to the end of the bolt which holds the iron plate in place. The mechanism may be adjusted to the rear from the position shown by removal of the bolt, the mechanism moved and relocated to the new position, and the bolt replaced.

Attached to adjustable spring holding mechanism 32 by means of an outstanding hook is one end of tension spring 34, the other end of spring 34 attached to rope 36. Rope 36 travels longitudinally along the side of the center support frame 16 until it reaches pulley 38 wherein the rope 36 engages and wraps partially around pulley 38 and then travels upward to attach to harness 40 which the exerciser places around his shoulder.

In practice, the person performing the sit-up exercise sits on seat cushion 18, reclines his back on hinged back cushion 20, and then places his feet on rear leg cushion 28. Foot hold down bar 30 would normally reside in a position about 6 inches above real leg cushion 28 which would be approximately 1 inch above the exerciser's legs, serving to provide support to prevent the legs from rising higher as the exerciser works out. The exerciser, now laying with his back in an inclined position, will place harness 40 around one shoulder, and then proceed to pivot upright at the waist against the restraining force applied by tension spring 34 through rope 36. It is anticipated that the sit-up restraining means comprising the mechanism 32, tension spring 34, rope 36, pulley 38, and harness 40 is duplicated on the opposite side of center support frame 16 so that the sit-up exerciser may work with one restraining means, or both restraining means simultaneously.

In utilizing the machine, the exerciser will do multiple sit-up movements, both rising and then returning to the original position. Obviously, by adjustment of rope 36, resisting tension can be applied at any point in the exercise, either from the beginning, or only to come in when the exerciser's back has reached a certain position. It is noted that by the placement of pulley 38, rope 36 attached to harness 40 places the restraining means on the exerciser's shoulder at an angle that is approximately 90° to the plane of the exerciser's back.

To allow the exerciser different initial inclined positions, selective placement of the back adjustable rod 22 in different openings 24, which openings are located across from each other on both front legs 14, are permitted.

Shown in dotted form for the use of the sit-up exercise bench 10 is an alternate, but well known exercise of lifting weights from a position of one being flat on their back. To accomplish this exercise, hinged back cushion 20 is lowered to a horizontal position, shown in dotted form, and then use is made of lifting weights (also shown in dotted form), whose center bar resides in stirrup 42. Stirrup 42 is attached to adjustable rod 44, which in turn slidably resides interiorly to front legs 14. A hole is drilled near the top of front leg 14 and pin 46 penetrates the hole to engage one of a plurality of like holes in adjustable rod 44 in order that the position of stirrup 42 may be adjusted to adjust the height of the weights above the bench.

With the additional exercising means above described, the exerciser can lower the hinged back cushion 20 to a flat position and, by lying prone on his back on sit-up exercise bench 10, can lift weights with his arms.

Figure 2:
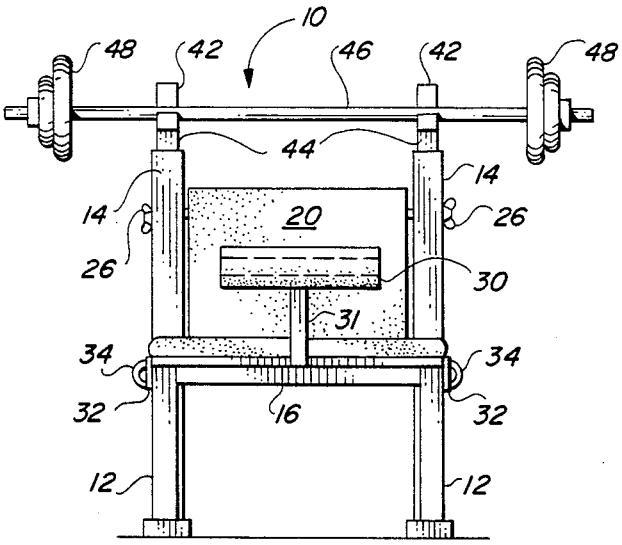
FIG. 2 is a rear elevational view of the inventive sit-up exercise bench.

Referring now to FIG. 2, an end elevational view of the sit-up exercise bench 10 is shown. Immediately visible, starting from the lower portion of the Figure, are the pair of rear legs 12, with the floor rubber feet attached, and the end of center support frame 16 which attaches to the top of the rear legs. Rising above the end of center support frame 16 is the foot hold down bar 30, rising upon a fixed support 31 centrally attached to center support frame 16. Shown centrally to foot hold down bar 30, in dotted form, is the surrounded central bar about which the padding and vinyl plastic cover is wrapped. Located between front legs 14, the bottommost portion of which is hidden below the center support frame 16 and cushion 28, is hinged back cushion 20. Holding hinged back cushion 20 in its slanted upright position is the back adjustable rod 22 (not shown), such rod having connected at both ends the wing nuts 26. Rising above the tops of front legs 14 are the pair of interiorly adjustable rods 44 which in turn are connected to stirrups 42. Residing within the concave portion of stirrups 42 is the weight center bar 46, with annular weights 48 on each end.

Additionally, shown in FIG. 2 is the end view of the adjustable hooks 32 and tension spring 34. Not visible are the attaching ropes 36 attached to their respective harnesses 40.

Figure 3:
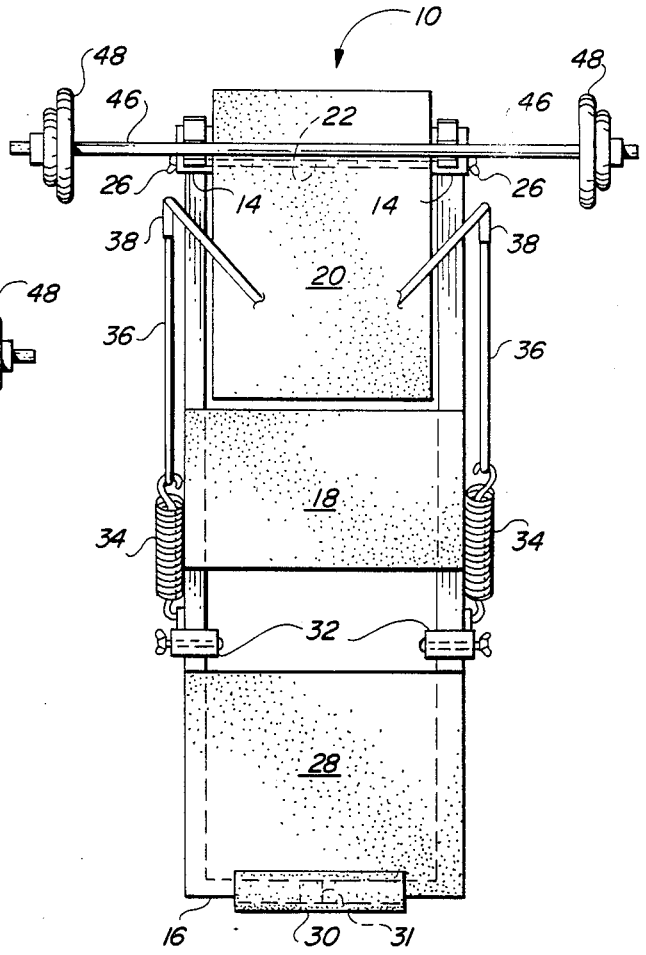
FIG. 3 is a top view of the inventive sit-up exercise bench.

Referring now to FIG. 3, a top view of the subject inventive sit-up exercise bench 10 with the seat cushion 18 and rear leg cushion 28 situated upon frame 16. Commencing at the rear portion, the outline (dotted) of the center support frame 16 is shown with the two side bars and the end piece. Attached to the end piece is fixed support 31 (shown in dotted form) which attaches to foot hold down bar 30. Proceeding upward on center support frame 16, the adjustable spring holding mechanism 32 is shown comprising the $\frac{3}{4}$th. square iron plate with opposite holes which receive the holding bolt and its wing nut for adjustable placement along the side pieces of center support frame 16. To this adjustable spring holding mechanism 32 is connected tension springs 34 (one on each side), which in turn is connected with rope 36. The ropes extend along each side of center support frame 16 where they engage pulleys 38 before turning upward. Ropes 36 are terminated in FIG. 3 prior to attachment to their respective harnesses 40 (not shown).

Further shown in top view of sit-up exercise bench 10 in FIG. 3 is at the terminus of center support frame 16 the front legs 14 with concentrically located adjustable rods 44 (not shown), which in turn are attached to stirrups 42. Crossing transversely the hinged back cushion 20 is the annular weights 48 central bar 46.

In utilizing the invention shown and described in FIGS. 1–3, the exerciser may adjust the relative position of the harnesses 40 if rope 36 is of a fixed length by adjustment of the relative position of spring 34 by adjustment of the adjustable spring holding mechanism 32. Also, as previously indicated, the initial starting position of the exerciser's back is adjustable by adjustment of the hinged back cushion 20 through selective placement of the back adjustable rod 22 (shown dotted in FIG. 3).

Figure 4:
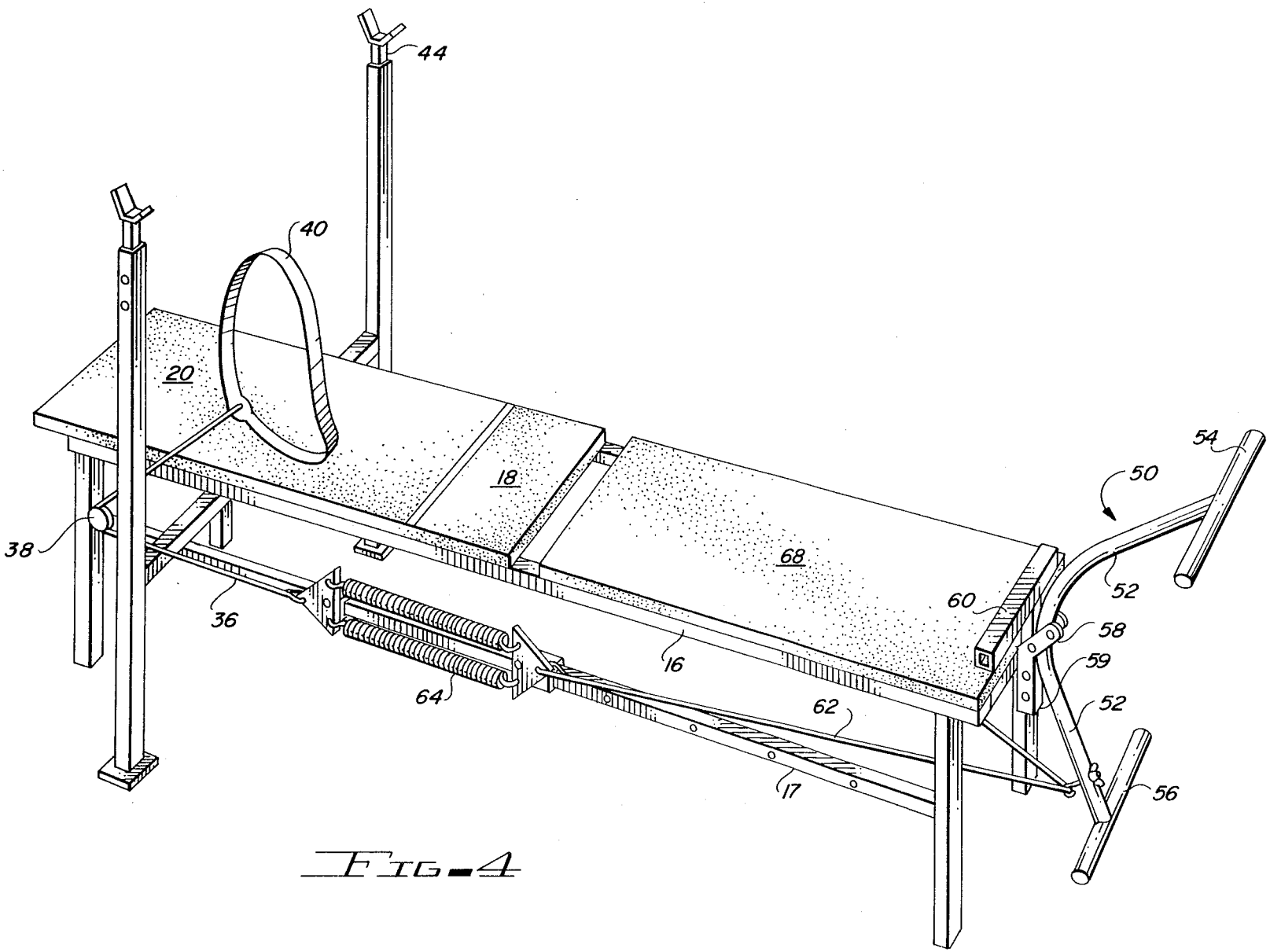
FIG. 4 is a perspective view of an alternate embodiment of the inventive sit-up exercise bench with additional leg exercise attachments.

Referring now to FIG. 4, a perspective view of an alternate embodiment of the invention coupled with a leg exerciser is detailed. More specifically, center support frame 16 and its top cushions, hinged back cushion 20, seat cushion 18, and an expanded rear leg cushion 68 provides means for the exerciser to lay fully prone on the bench for the expanded exercises. Added to the bench at the rear end portion thereof is the leg exercise mechanism 50 comprising an arcuate shaped bar 52 with upper transverse bar end 54 and lower transverse bar end 56, each attached at a 90° angle to the arcuate-shaped bar 52 at the upper and lower ends respectively. Arcuate-shaped bar 52 is pivotally attached in its center area to the end portion of frame 16 by means of a pivot mechanism. The pivot mechanism shown in FIG. 4 comprises a pair of parallel metal bars 58 with a pin at each end connecting the bars, one of such pins passing through an opening crosswise in arcuate-shaped bar 52, and the other pin passing through a hole in a rectangular shaped metal sleeve 59 attached to the end of frame 16. It is noted that the rectangular shaped sleeve 59 attached to the end of frame 16 has a plurality of holes passing through it in order that the parallel bars on each side of sleeve 59 may be located at variable positions. By such choice of placement, the height of the pivoting point of arcuate shaped bar 52 may be raised or lowered for the convenience of the exerciser.

It is additionally noted that one of the two spring tension mechanisms 64 (the other spring tension mechanism located on the opposite side of frame 16 and not shown) is detailed. In this FIG. 4, spring mechanism 64 comprises a pair of rectangular plates with a plurality of hooks on one side by which one or more tension springs may be connected. The rope 36 which passes over pulley 38 to harness 40 attaches at the corner of one of the triangles opposite the spring hooks, and that a hole is located somewhat central to the triangle piece. The purpose of the central hole is to permit a bolt to engage and hold the triangle piece to frame 16, or, as shown in FIG. 4, to the added frame support 17 passing between the front and the rear legs. In the illustration shown in FIG. 4, the lower portion of arcuate-shaped bar 52 is attached to the spring tension mechanism 64 by means of an eye bolt whose shank passes through arcuate-shaped bar 52, and rope 62 which attaches the eye of the eye bolt to the right hand side triangle piece of spring tension mechanism 64. In the particular situation shown in FIG. 4, the left handed triangle pice of spring tension mechanism 64 will be held stationary by the bolt attaching both frame support 17 and the triangle piece.

Additionally, at the rear end portion of the sit-up bench shown in FIG. 4, foot hold down bar 60 is shown placed in its lowest most position, next to expanded rear leg cushion 68. The vertical bar attached to foot hold down bar 60 slides interiorly to sleeve 59 which allows height adjustment for the pivoting mechanism 58. The same pin of the pivot mechanism parallel bars 58 used to adjust the pivotal position of arcuate shaped bar 52 is used to adjust foot hold down bar 60. Obviously the vertical bar attached to foot hold down bar 60 is penetrated by a plurality of holes.

In using the leg exercise embodiment of FIG. 4, the exerciser first needs to secure spring tension mechanism 64 by loosening the right hand triangle piece from frame support 17 by removal of the bolt engaging the hole in the triangular piece and then secure the left hand triangle piece of spring tension mechanism 64 to frame support 17 in order that the arcuate-shaped bar 52 may pull on the spring through rope 62. To exercise using the lower transverse bar 56, the exerciser sits on the rear end portion of the sit-up bench with the arcuate-shaped bar 52 between his legs, placing lower transverse bar 56 on the front part of his foot, preferably near the point where the foot joins the leg. Then, by raising his legs up, pivoting outward, the exerciser pivots arcuate-shaped bar 52 about its pivot mechanism, lower transverse bar 56 then swinging in an arc upwards.

The travel of lower transverse bar 56 is opposed by spring tension mechanisn 64 so that exerciser will have resistance to the movement of his legs, and thus will gain the exercise desired. The amount of spring tension which resists the exerciser's leg movement may be varied by placement of different tensioned springs between the two end triangular pieces of spring tension mechanism 64 or, multiple springs may be employed in spring tension mechanism 64 to increase the tension. Conversely, fewer springs or weaker springs, will lessen the spring reistance.

To accomplish the leg exercises utilizing upper transverse bar 54, the exerciser lies flat on the sit-up bench, stomach down, with the exerciser's knees near the rear end portion of expanded rear leg cushion 68. Then, the exerciser places his legs on either side of the arcuate-shaped bar 52 with the portion of his body between the ankle and the leg just under and thereby engaging, upper transverse bar 54. Then, the exerciser will, while laying on his stomach, bring his lower leg towards him, such as to close the angle made by the upper and lower portion of the legs, and in doing so, rotates arcuate-shaped bar 52 and upper transverse bar 54 will swing in an arc towards the front portion of the sit-up bench. Again, movement of the arcuate-shaped bar about its pivotal mechanism will be opposed by the spring tension mechanism 64, the operation of this mechanism similarily as explained above.

It is noted in the alternate embodiment shown in FIG. 4, that some additional changes have been made to the construction of the sit-up bench over that shown in the FIGS. 1–3. For example, the mechanisms holding the weights overhead for use by the exerciser has been moved a short distance towards the center of the sit-up bench, and that the spring mechanism attaches to frame support 17 residing slightly lower than the center support frame 16. Further, it is anticipated that two spring tension mechanisms such as shown by member 64 will be utilized in the alternate embodiment, one such mechanism on each side of the bench. A portion of the rope connecting arcuate-shaped bar 52 to the second spring tension mechanism is shown in FIG. 4.

While a preferred and alternate embodiment of Applicant's invention has been shown and described, it is appreciated that still other embodiments of the invention are possible and that there is no intent to limit the invention by such disclosure, but rather it is intended to cover all modifications and alternate embodiments falling within the spirit and the scope of the invention as defined by the appended claims.

I claim:

1. An exerciser's sit-up exercise bench comprising:

a horizontal frame platform having a first end, a second end, and first and second elongated sides with a seat and lower leg rest;

a slanted back rest pivotally attached proximate said first end of said horizontal frame platform; and shoulder restraining means adapted to be engaged by an exerciser's shoulder, said shoulder restraining means including a shoulder harness, a rope attached at one end to said shoulder harness, a pulley rotationally attached to said first of said elongated sides of said horizontal platform proximate said first end, said pulley adapted to receive said rope attached to said should harness, and a restraining spring operably attached to said first elongated side of said horizontal frame, said rope other end attached to said restraining spring, said pulley so located upon said horizontal platform proximate said first end that the rope between the pulley and the shoulder harness forms an approximate 90° angle with the plane of the exerciser's back when the exerciser reclines on the slanted back rest whereby an exerciser, reclining upon the bench, may perform sit-up exercises from the waist up, raising up against resistance against the shoulder provided by the restraining spring.

2. The exerciser's sit-up exercise bench as defined in claim 1 further including an adjustable hook mechanism, said adjustable hook mechanism interposed said restraining spring and said horizontal frame platform, said adjustable hook mechanism adapted to be attached to one elongated side of said horizontal frame platform at one of a plurality of positions.

3. The exerciser's sit-up exercise bench as defined in claim 2 further including a foot hold down bar, said foot hold down bar comprising a horizontal bar situated at an elevated position above the horizontal platform proximate said second end.

4. The exerciser's sit-up exercise bench as defined in claim 3 further including an arm weight lifting mechanism, said arm weight lifting mechanism situated proximate said slanted back-rest whereby an exerciser may place said slanted back-rest in a horizontal position, lay flat on said platform, and proceed to exercise said arm weight lifting mechanism with his arms.

5. The exerciser's sit-up exercise bench as defined in claim 4 wherein said arm weight lifting mechanism comprises a pair of upright weights holding yokes operably attached to and situated on opposite sides of said horizontal frame platform, elongated sides said yokes adapted to receive an associated elongated bar having weights at each end.

6. The exerciser's sit-up exercise bench as defined in claim 3 further including a second shoulder restraining means adapted to be engaged by an exerciser's shoulder, said second shoulder restraining means including a second shoulder harness, a second rope attached at one end to said said second shoulder harness, a second pulley rotationally attached to the second of said elongated sides of said horizontal platform proximate said first end, said second pulley adapted to receive said second rope attached to said second shoulder harness, and a second restraining spring operably attached to said horizontal frame second elongated side, said second rope other end attached to said second restraining spring, said second pulley so located upon said horizontal platform second elongated side proximate said first end that the rope between the pulley and the second shoulder harness forms an approximate 90° angle with the plane of the exerciser's back when the exerciser reclines on the slanted back rest.

7. The exerciser's sit-up exercise bench as defined in claim 6 further including:

leg exercise means located proximate said horizontal frame platform at said second end, said leg exercise means including an arcuate shaped bar having respective cross members attached at each end, said arcuate shaped bar pivotably attached to said horizontal frame platform second end proximate said arcuate shaped bar's center, and said arcuate shaped bar operably connected to said first and second restraining springs whereby an exerciser, while lying upon said platform, may engage either of said cross bars attached to said arcuate shaped bar with his feet, and thereby partially rotate said arcuate shaped bar against said restraining springs, and the exerciser may perform sit-up exercises by raising up at the waist and pulling against the shoulder restraining means.

* * * * *